US005630273A

United States Patent [19]

Kobayashi et al.

[11] Patent Number: 5,630,273

[45] Date of Patent: May 20, 1997

[54] HOLDING JIG AND METHOD FOR TEMPORARILY RETAINING LAST-IN TERMINALS

[75] Inventors: Takashi Kobayashi; Masayoshi Imoto, both of Yokkaichi, Japan

[73] Assignee: Sumitomo Wiring Systems, Ltd., Japan

[21] Appl. No.: 453,917

[22] Filed: May 30, 1995

[30] Foreign Application Priority Data

Aug. 24, 1994 [JP] Japan ..... 6-199664

[51] Int. Cl.[6] ..... H01R 43/20

[52] U.S. Cl. ..... 29/881; 29/755; 29/760; 269/903

[58] Field of Search ..... 29/461, 748, 749, 29/755, 758–760, 752, 33 M, 842, 881; 269/903

[56] References Cited

U.S. PATENT DOCUMENTS

| | | | |
|---|---|---|---|
| 4,420,020 | 12/1983 | McGeary et al. | 29/749 X |
| 4,493,147 | 1/1985 | Bakermans | 29/748 X |
| 4,837,926 | 6/1989 | Boutcher, Jr. | 269/903 X |
| 4,965,928 | 10/1990 | Verge | 29/760 X |

FOREIGN PATENT DOCUMENTS

| | | | |
|---|---|---|---|
| 134382 | 10/1979 | Japan | 29/755 |
| 6-33479 | 3/1994 | Japan | 29/760 |
| 1205325 | 1/1986 | U.S.S.R. | 269/903 |

*Primary Examiner*—Peter Vo

*Attorney, Agent, or Firm*—Jordan B. Bierman; Bierman, Muserlian and Lucas LLP

[57] ABSTRACT

A holding jig for temporarily holding a plurality of last-in terminals of a wire harness, the holding jig removably surrounding the terminal. In a preferred embodiment, guiding devices which permit the terminals to be transferred are provided.

By temporarily holding a last-in terminal in the jig, deformation in transport, and tangling in manufacture, etc. can be avoided. In addition, in another preferred embodiment, the temporarily held last-in terminals not yet inserted can be inserted even into connectors in which some last-in terminals are already present.

17 Claims, 14 Drawing Sheets

HOLDING JIG AND METHOD FOR TEMPORARILY RETAINING LAST-IN TERMINALS

This Application claims the benefit of the priority of Japanese Application 6-199664, filed Aug. 24, 1994.

The present Invention relates to a temporary holding jig for last-in terminals and an insertion jig for use therewith. More particularly, it is directed to such a jig which is most suitable for the manufacture of wire harnesses by preparing temporary binding circuits and then carrying out the final binding process.

BACKGROUND OF THE INVENTION

In general, a wire harness is an electric wiring system containing a number of cables, often as many as 400–500 circuits. When producing such large scale wire harnesses, a plurality of unit cable binding assemblies (called temporary binding circuits) is first manufactured. These are then electrically connected by various means by what is called a final binding process.

The temporary binding circuit contains last-in terminals for various design reasons. The last-in terminals are terminals which are fastened to the ends of a plurality of cables comprising the wire harness and are mounted onto a connector at the final binding of the temporary binding circuits or when connecting the wire harness to a desired device (the last-in process). In other words, this last-in terminal is left exposed on the end of the cable until the last-in process is carried out.

The existence of the last-in terminal creates various problems in manufacturing wire harnesses; e.g. its susceptability to deformation during transport. Obviously, if the terminal is deformed, mounting on a connector becomes difficult, continuity of the cable may be compromised, etc. Similarly, there is a tendency of cable components fastened to the last-in terminal to become entangled with other cable components, thus making handling difficult.

Also, the last-in process is labor intensive; i.e. there are many cases wherein a plurality of last-in terminals is connected to a common connector. In such cases, cables connected to the last-in terminal which had been previously inserted prevented the last-in terminals of succeeding temporary binding circuits from being inserted.

SUMMARY OF THE INVENTION

The present invention is intended to solve the foregoing problems by the provision of a temporary holding jig for the last-in terminals which permits practical handling of the last-in terminal. An insertion jig to be used therewith is also provided.

The last-in terminals are fastened to a plurality of corresponding cables which comprise the wire harness, and each is temporarily held in the insertion Jig. The jig is equipped with receiving chambers, which are formed by partitioning the main body, for removably accommodating the terminals. Advantageously, the receiving chambers have terminal inlets and terminal exits to permit insertion and removal of the terminals in one direction. A stop retains the terminals between the inlets and the exits, and releases the terminals when they are urged towards the exits.

In a desirable form of the invention, the exit is positioned adjacent the terminal insertion opening of a connector. This permits the use of a pusher to urge the terminals out of the exit and into the connector. A particularly efficient pusher has a plurality of contact members, each of which corresponds to one of the terminals; thus, all of the terminals in the jig can be inserted into the connector in one step.

When the last-in terminal has been inserted into the connector, the cable attached thereto is in the receiving chamber. It is removed by passing it through a gap in the chamber provided for this purpose. If some last-in terminals have been inserted into the connector in advance, the cables can be readily inserted and/or removed through the gap.

BRIEF DESCRIPTION OF THE DRAWINGS

In the accompanying drawings, constituting a part hereof and in which like reference characters indicate like parts.

DETAILED DESCRIPTION OF THE INVENTION

Figure 1:
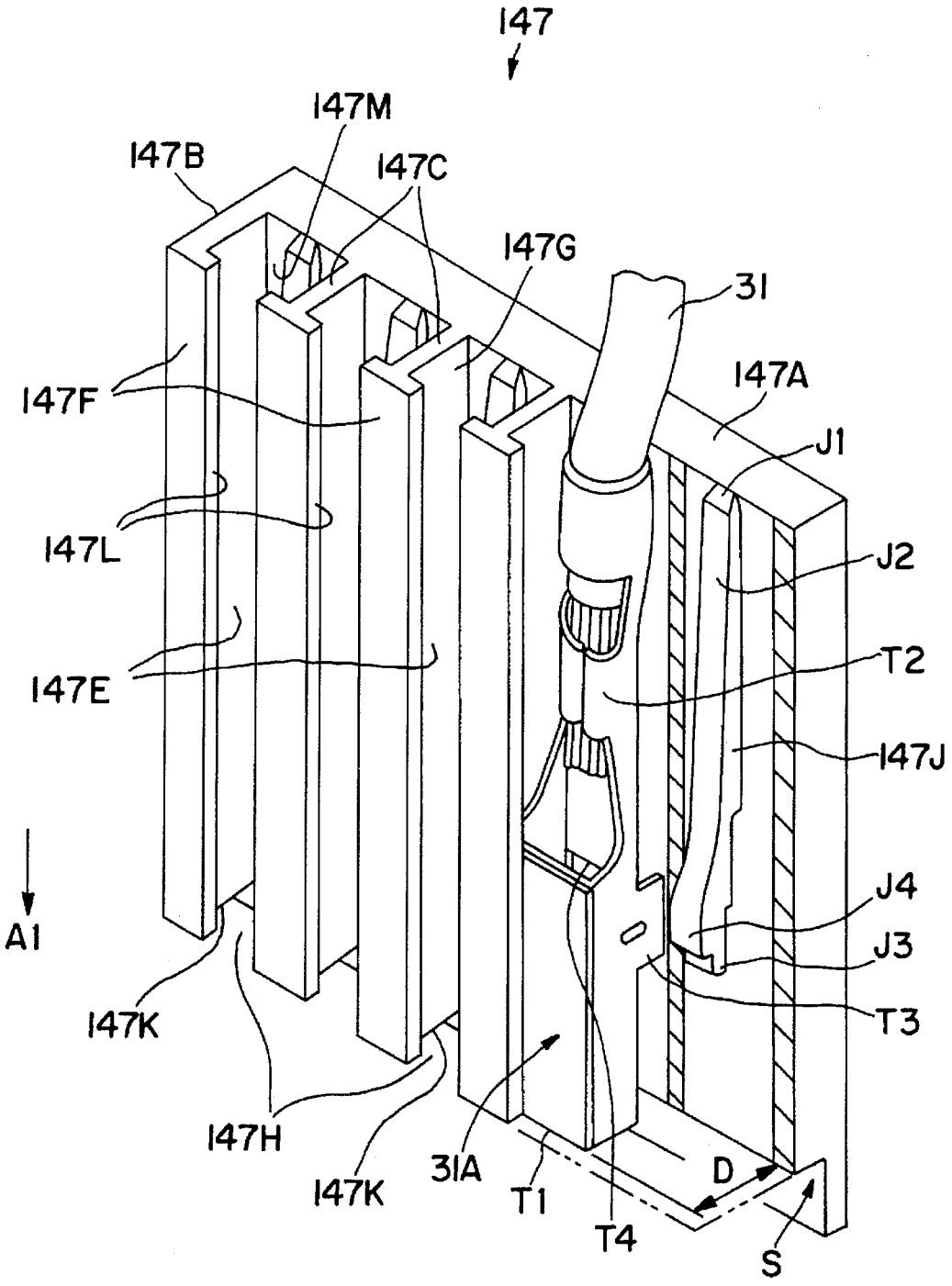
FIG. 1 is a perspective view, partially broken away showing a temporary holding jig in accordance with the present Invention.
Figure 2:
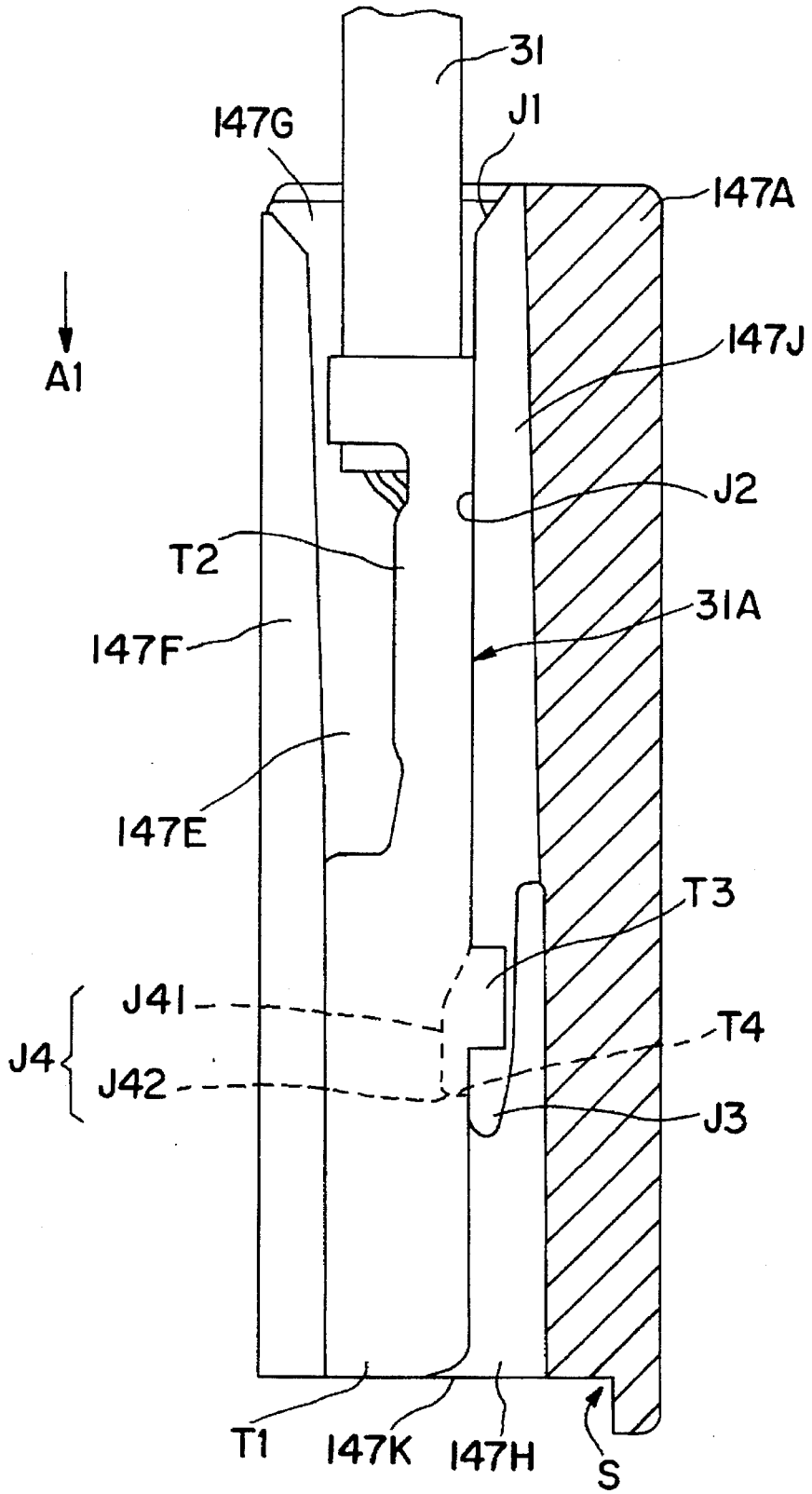
FIG. 2 is a vertical sectional view of the holding jig of FIG. 1.

With reference to FIGS. 1 and 2, holding jig 147 temporarily holds terminal 31A; terminal 31A is a female terminal, to be connected to a male terminal (not shown) and is integrally equipped with tip T1. Barrel T2 is crimped on the end of cable 31. Between tip T1 and barrel T2, there is a pair of stabilizers T3; terminal 31A is also provided with lance holes T4 as stops. Terminal 31A constitutes a last-in terminal to be inserted into the connector housing by the last-in process. The last-in process means a process for binding a plurality of temporary binding circuits 1x and 2x. However, in the present invention, the last-in process includes a wide range of processes for connecting wire harnesses to equipment (for instance, automobiles).

Holding jig 147 comprises main body 147A of generally rectangular plate form. Main body 147A is preferably resin molded with an integral pair of side walls 147B and a plurality of partitions 147C parallel to side wall 147B and spaced apart from each other. Between side walls 147B and the adjacent partitions 147C, as well as between adjacent partitions 147C, terminal receiving chambers 147E accommodate terminals 31A.

Cross pieces 147F extend parallel to the plane of main body 147A and are desirably integral therewith. Each receiving chamber 147E is in channel form with a U-shaped cross section. The upper edge (as shown in FIGS. 1 and 2) of each chamber 147E comprises a terminal entry 147G for insertion of terminal 31A lead by tip T1. The lower edge (as seen in FIGS. 1 and 2) comprises terminal exit 147H to allow terminals 31A to be removed therethrough. Thus, entry 147G and exit 147H allow terminals 31A to enter and leave receiving chamber 147E by movement thereof in one direction. Each of cross pieces 147F is spaced apart from its adjacent cross piece 147F by gap 147L. Gap 147L constitutes an opening through which cable 31 may pass both inwardly and outwardly.

Receiving chambers 147E are provided with ribs 147J extending from entry 147G to exit 147H and are advantageously integrally formed with chambers 147E. Each rib 147J comprises inclined surface J1, which guides terminal 31A as it is introduced into chamber 147E through entry 147G in a terminal entering direction (arrow A1 in FIGS. 1 and 2). Thereafter, ramp J2, which rises smoothly away from body 147A, guides terminals 31A so that edge J3 is resiliently lifted away from main body 147A. Contiguous to ramp J2 is stop J4, which is adapted to enter lance hole T4 when terminal 31A is fully in chamber 147E. Thus, rib 147J and stop J4 cooperate to allow terminal 31A to be temporarily held in receiving chamber 147E and to release terminal 31A when terminal 31A is urged in the terminal entering direction A1.

With reference to FIG. 2, when tip T1 of terminal 31A enters entry 147G and moves into receiving chamber 147E along ramp J2, stop J4 is displaced toward main body 147A as a result of resilient deflection of edge J3, thereby allowing terminal 31A to enter. When stop J4 is opposite lance hole T4, it enters hole T4 and terminal 31A is firmly held between side walls 147B, partitions 147C, main body 147A, and cross pieces 147F, by the elasticity of edge J3.

The back side of guide J41, which guides the lower surface of tip T1, is smoothly connected to ramp J2 and shoulder J42, as shown in FIG. 2. As terminal 31A moves in direction A1, after being temporarily held, the back face of guide J41 is displaced by the rim of lance hole T4, thereby releasing stop J4. However, if terminal 31A is pulled towards entry 147G, shoulder J42 bears against lance hole T4 and prevents movement of terminal 31A. Therefore, terminal 31A will not release in this direction. Moreover, if it is attempted to introduce 31A from exit 147H, shoulder J42 of stop member J4 contacts terminal 31A and prevents entry. Therefore, even if an operator tries to manually insert terminal 31A into holding Jig 147 from the wrong direction, stop J4 will prevent the error.

Figure 3:
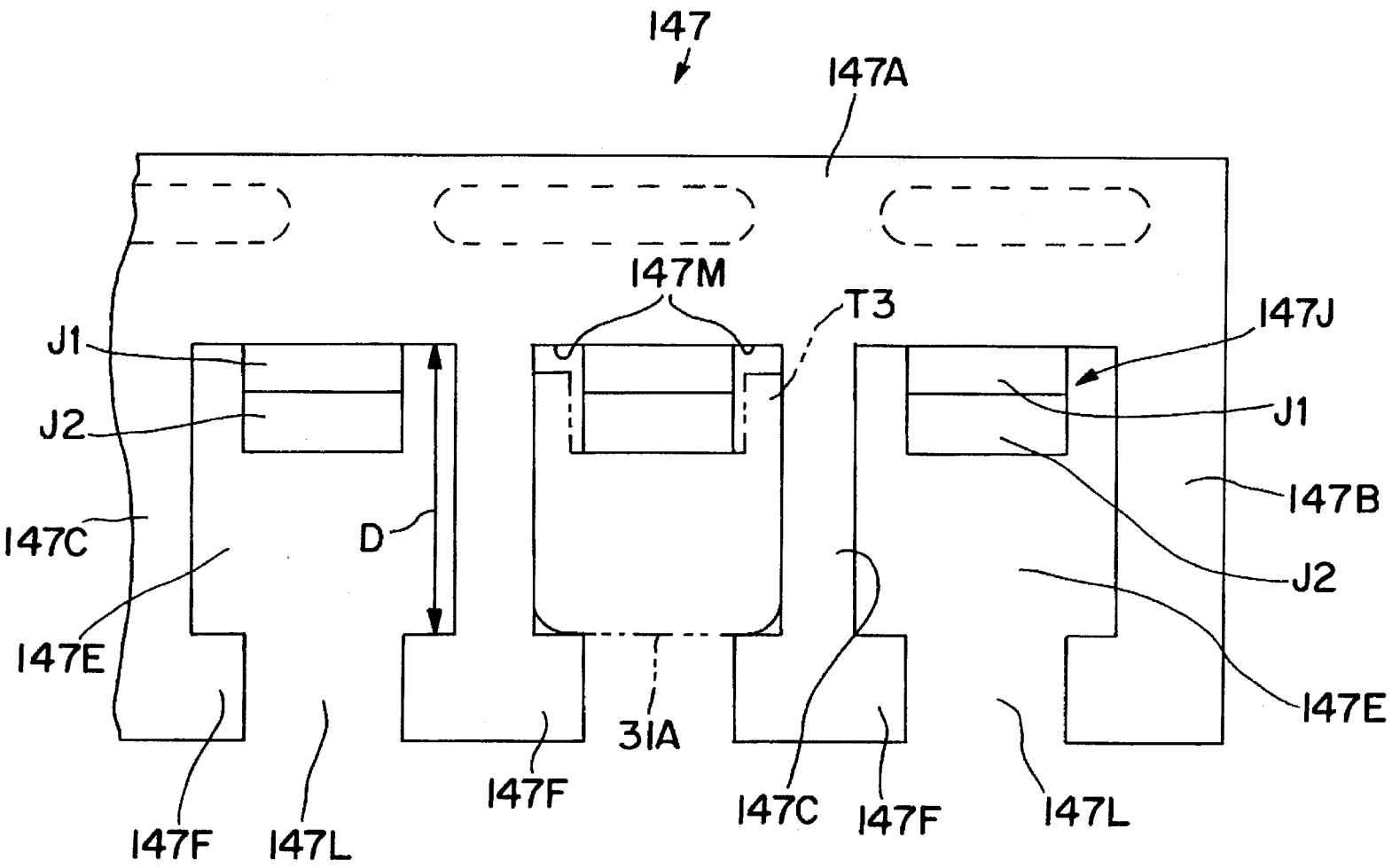
FIG. 3 is an enlarged plan of the holding jig of FIG. 1.

In a further refinement of the invention, as shown in FIG. 3, a pair of entry slots 147M, which receive stabilizers T3, is provided. Cross pieces 147F define depth D of slot 147M so that terminal 31A can enter receiving chamber 147E only when stabilizer T3 is properly positioned. Thus, the insertion position of terminal 31A is uniformly defined, and mistakes by the operator are prevented.

With reference to FIGS. 1 and 2, side wall 147B and partitions 147C have the same length in the A1 direction as receiving chamber 147E. Thus, lower end 147K is coplanar with tip T1. However, main body 147A is longer in the A1 direction than side wall 147B and partition 147C, but its upper edge is flush with the upper edge of side walls 147B and partitions 147C. Therefore, the lower edge of main body 147A extends below lower end 147K. The extended portion of main body 147A is thinner than the rest of the body, thereby forming ledge S which is coplanar with lower end 147K. Ledge S positions exit 147H in register with insertion inlets CP of connectors C1 and C2 (see FIG. 5). The exterior of main body 147A is complementary to the standard female connector. Thus, by mounting holding jig 147 on the usual connector testing device, a test of the continuity of cable 31 can be easily carried out.

Figure 4:
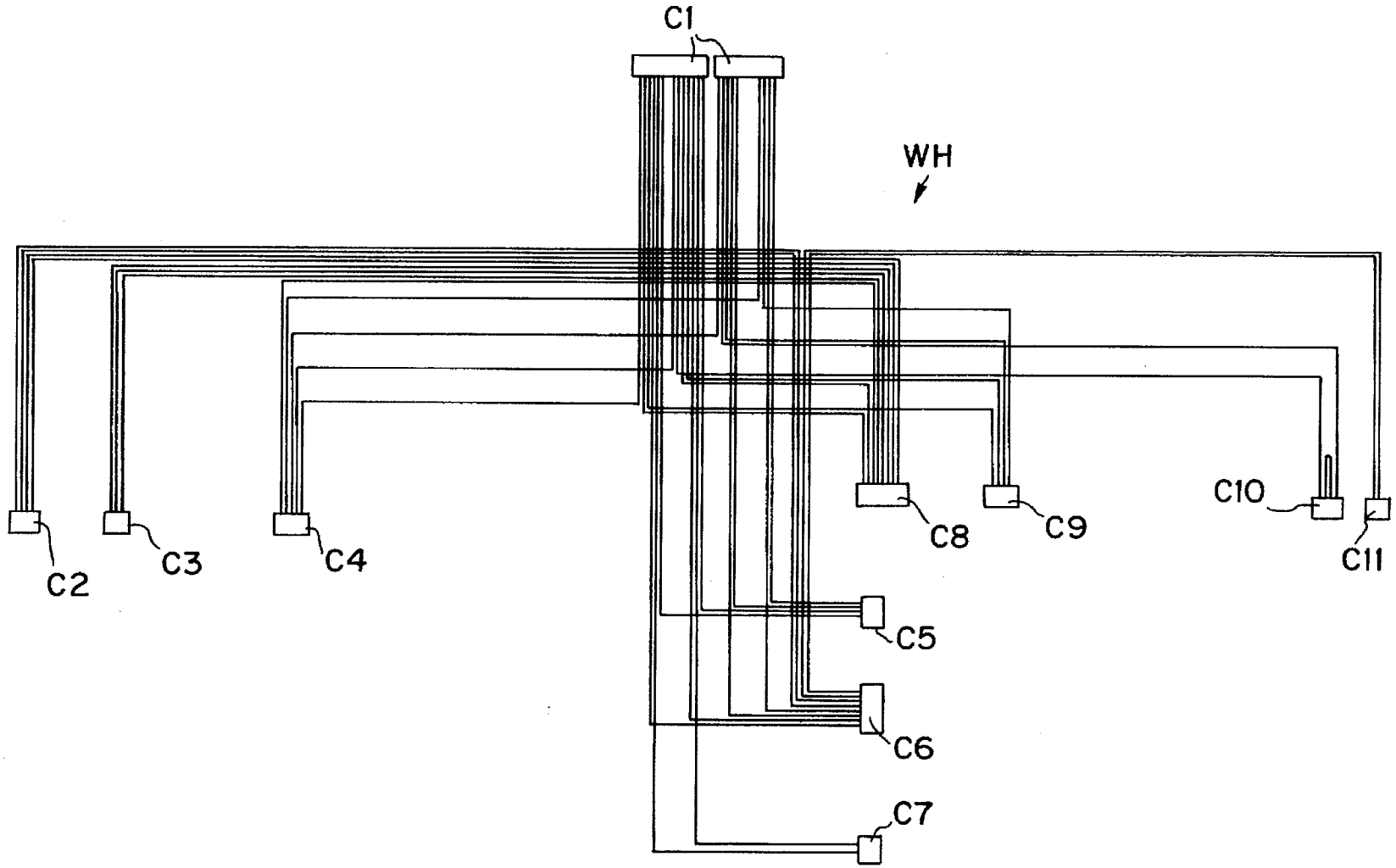
FIG. 4 is a schematic view of a wire harness in accordance with the present Invention.
Figure 5:
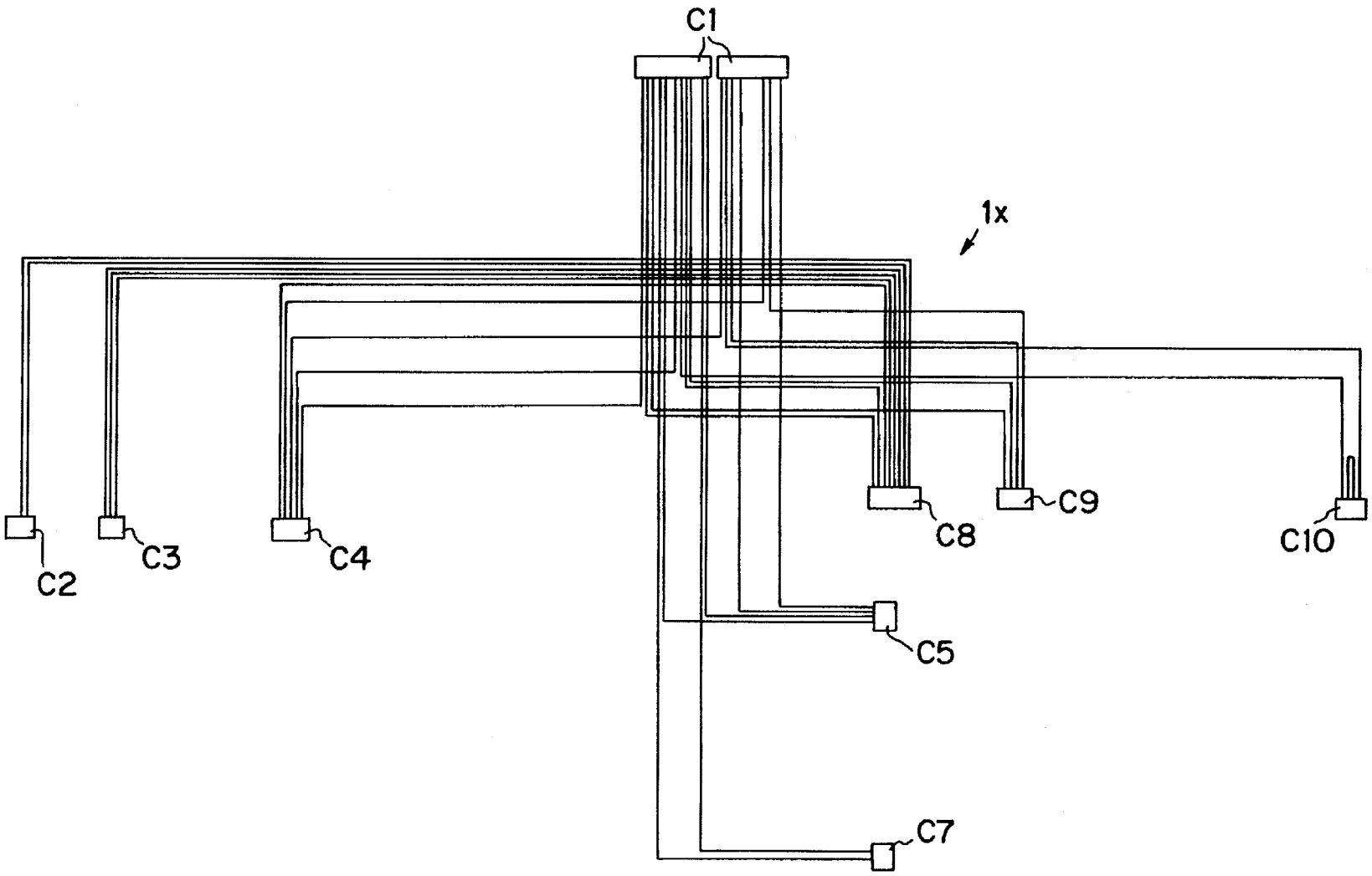
FIG. 5 is a schematic view of a temporary binding circuit which is an element of the wire harness of FIG. 4.
Figure 6:
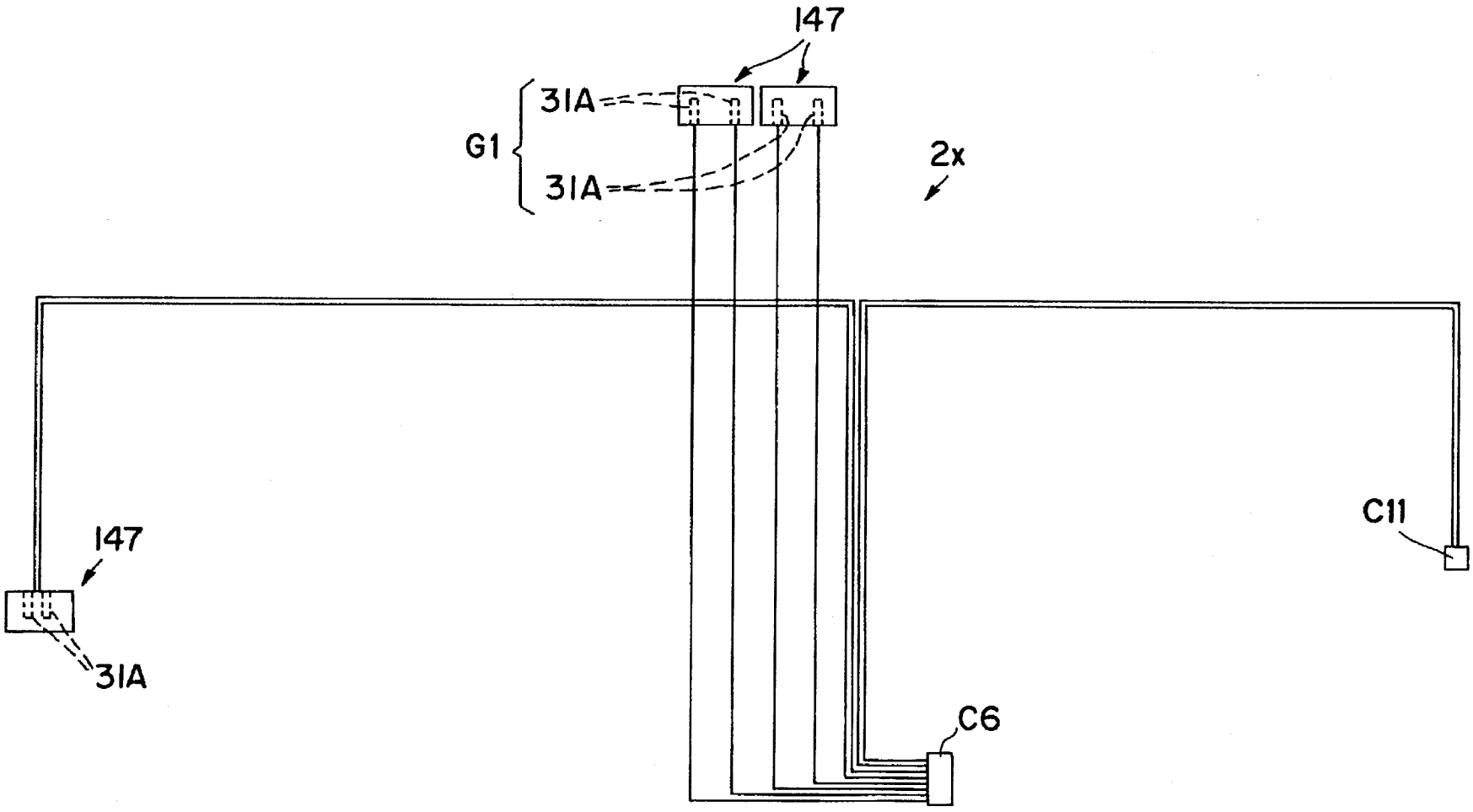
FIG. 6 is another temporary binding circuit which comprises the wire harness of FIG. 4.

Temporary binding circuit 1x (as shown in FIG. 5) and temporary binding circuit 2x (as shown in FIG. 6) are premanufactured and combined to form wire harness WH (as shown in FIG. 4). Each of circuits 1x and 2x is produced by automatic wire harness manufacturing apparatus which determines the length of cables 31, strips the ends thereof, crimps process terminals 31A to the stripped cable, and inserts terminals 31A into connectors C1 to C11. Binding circuit 2x (FIG. 6) comprises group G1 of terminals 31A as the last-in terminal to be connected to connector C1 of binding circuit 1x (FIG. 5) and group G2 of terminals 31A to be connected to connector C2.

In the terminal insertion process, when manufacturing binding circuit 2x, all groups G1 and G2 of last-in terminals 31A are accommodated in holding jig 147 as shown in FIGS. 1 to 3. Such terminal insertion devices are described in Applicants' Japanese Patent Application 6-33479. By connecting each terminal 31A held by holding jig 147 with connectors C1 and C2, both binding circuits 1x and 2x combine to form wire harness WH of FIG. 4 wherein the predetermined circuits are electrically connected.

Figure 7:
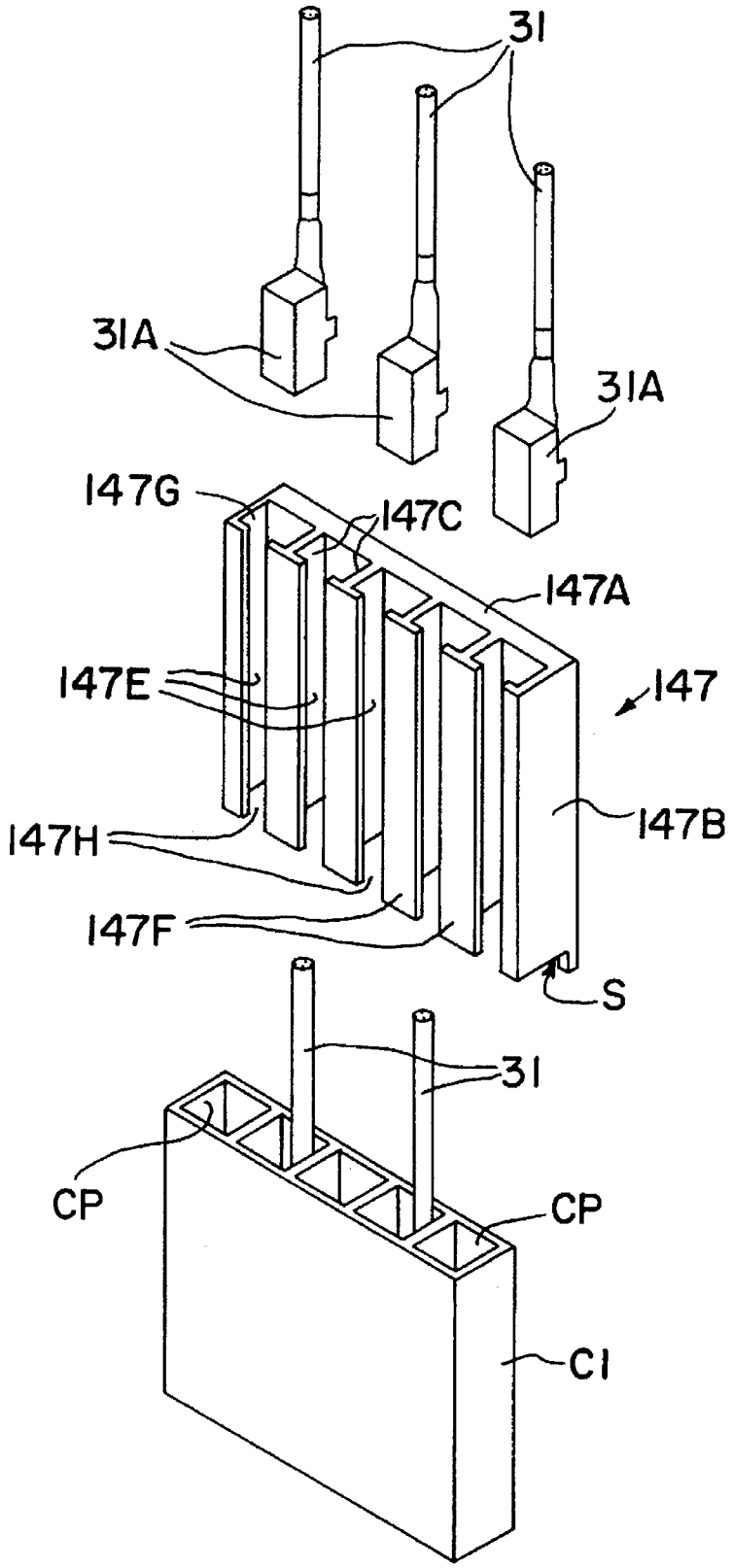
FIG. 7 is an exploded perspective view showing the first step in the last-in process according to the Invention.
Figure 8:
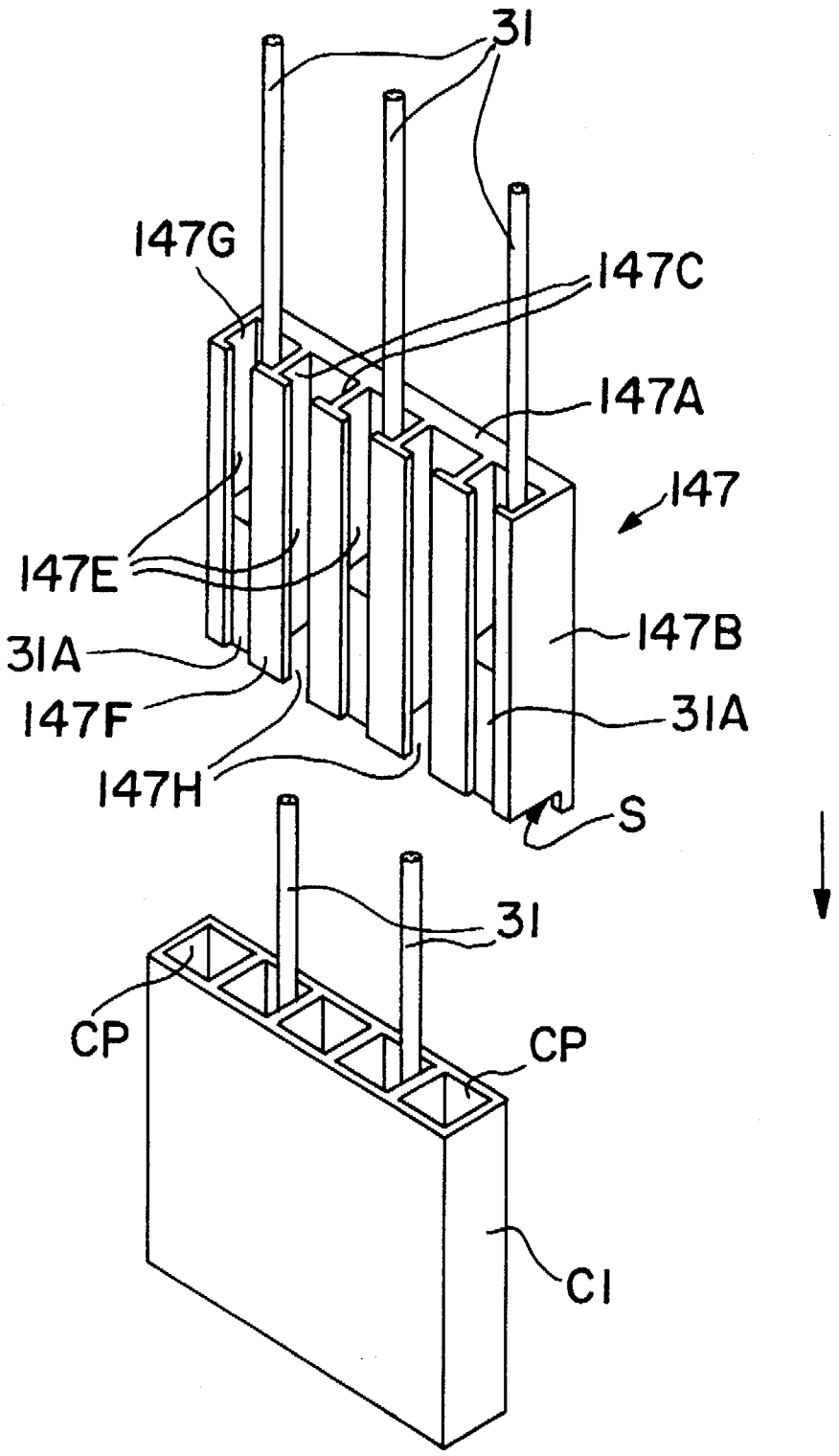
FIG. 8 is an exploded perspective view showing a further step in the process of FIG. 7.
Figure 13:
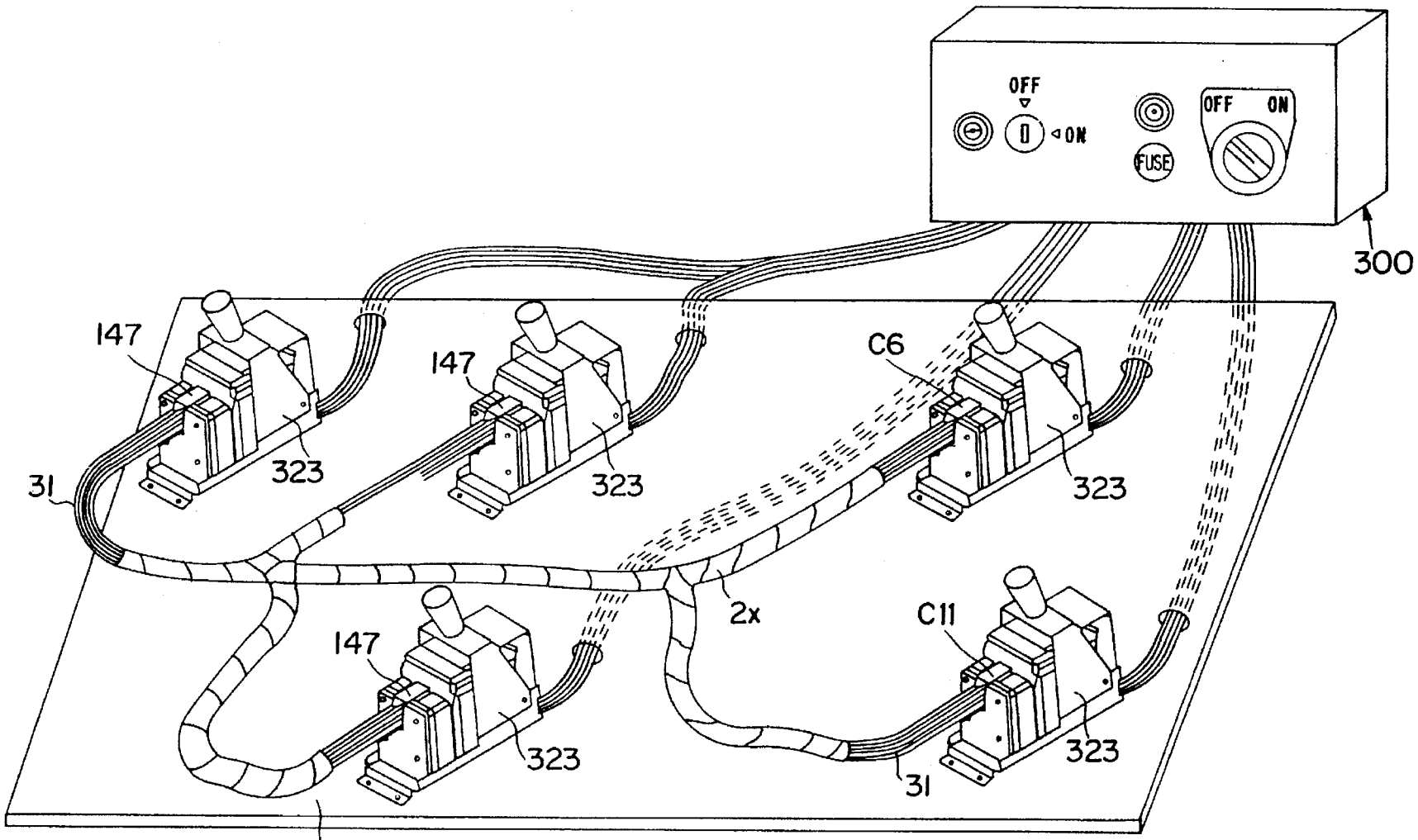
FIG. 13 is a perspective view of an assembly board for continuity testing.

With reference to FIG. 7, when each terminal 31A is inserted into chamber 147E, it is retained therein by stop J4, as shown in FIGS. 1 and 2. Chambers 147E correspond to insertion inlets CP which, in turn, are complementary to connectors C1 and C2. As shown in FIG. 8, terminals 31A are retained in connector C1. This temporary holding process is carried out together with the terminal insertion process in manufacturing binding circuit 2x. Next, as shown in FIG. 13, the continuity test of binding circuit 2x is carried out by temporarily placing terminals 31A on assembly board 220. On assembly board 220, a plurality of testers 323, which correspond to connectors C1, C6, temporary holding jig 147, etc. of binding circuit 2x are arranged. The testing device detects the continuity of each terminal 31A connected to corresponding connectors C1, C6 and holding jig 147 and, if the continuity is acceptable, outputs an appropriate signal to controller 300.

The exterior of holding jig 147 conforms to testing devices 323, so that terminals 31A are complementary to the their corresponding connectors (in the present case, connectors C1 and C2 of binding circuit 1x). Therefore, the connections of terminals 31A can be predetermined and the continuity test, even for binding circuit 2x, can be readily carried out. Binding circuits 1x and 2x which have passed the continuity test are bound and completed as wire harness WH. Thereafter, holding jig 147, which temporarily holds terminals 31A, is transferred to corresponding connectors Cl or C2.

Figure 9:
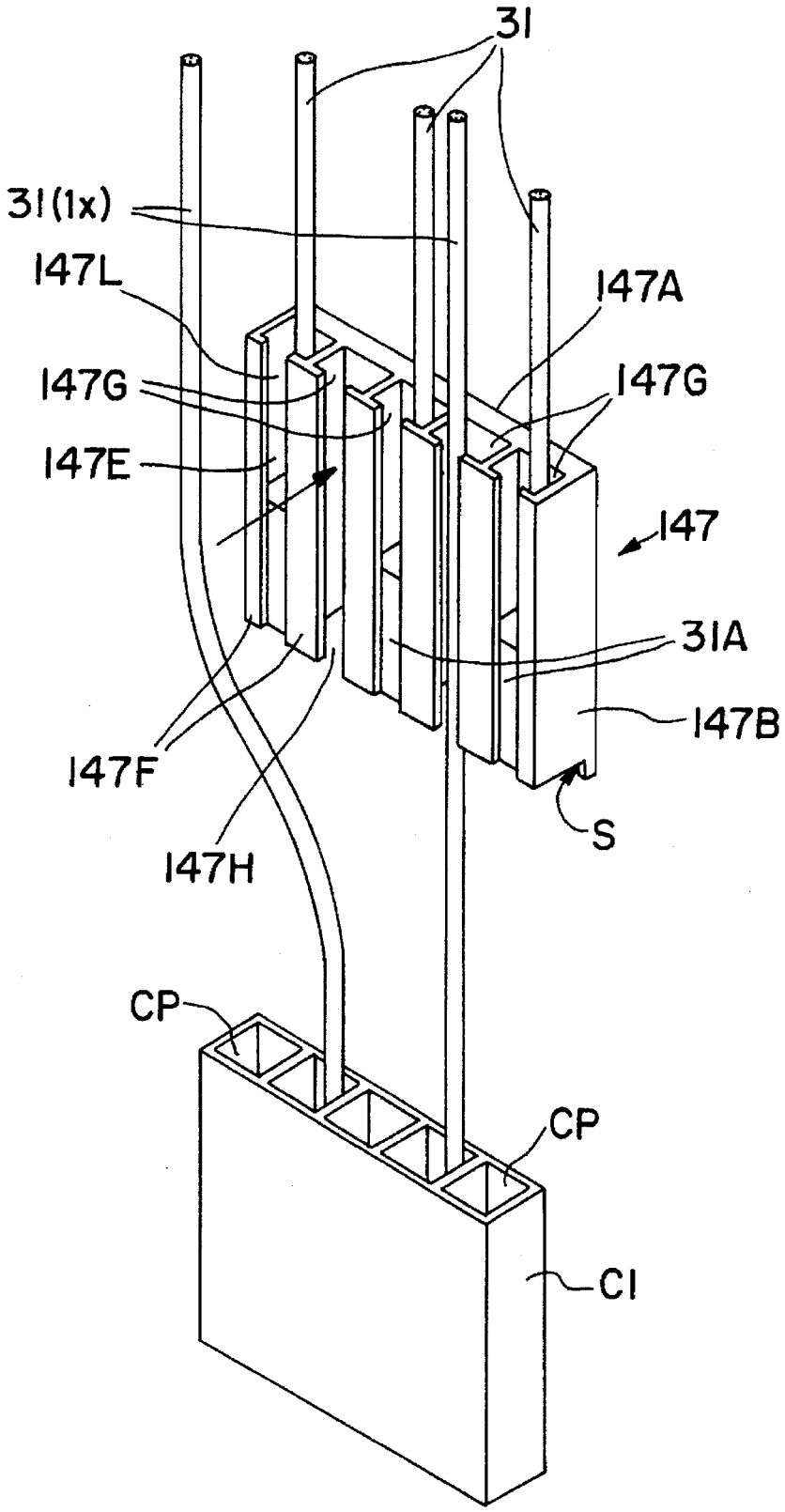
FIG. 9 is an exploded perspective view of a still further step in the process of FIG. 7.

As shown in FIG. 9, certain cables 31 of binding circuit 1x have previously been attached to connectors C1 and C2 in insertion inlet CP. Terminals 31A have been inserted into some receiving chambers 147E. Cables 31 are to be inserted into those chambers 147E which are vacant without disturbing the remaining cables or terminals. This is accomplished by passing the appropriate cables 31 through gaps 147L into and out of receiving chambers 147E as needed.

Figure 10:
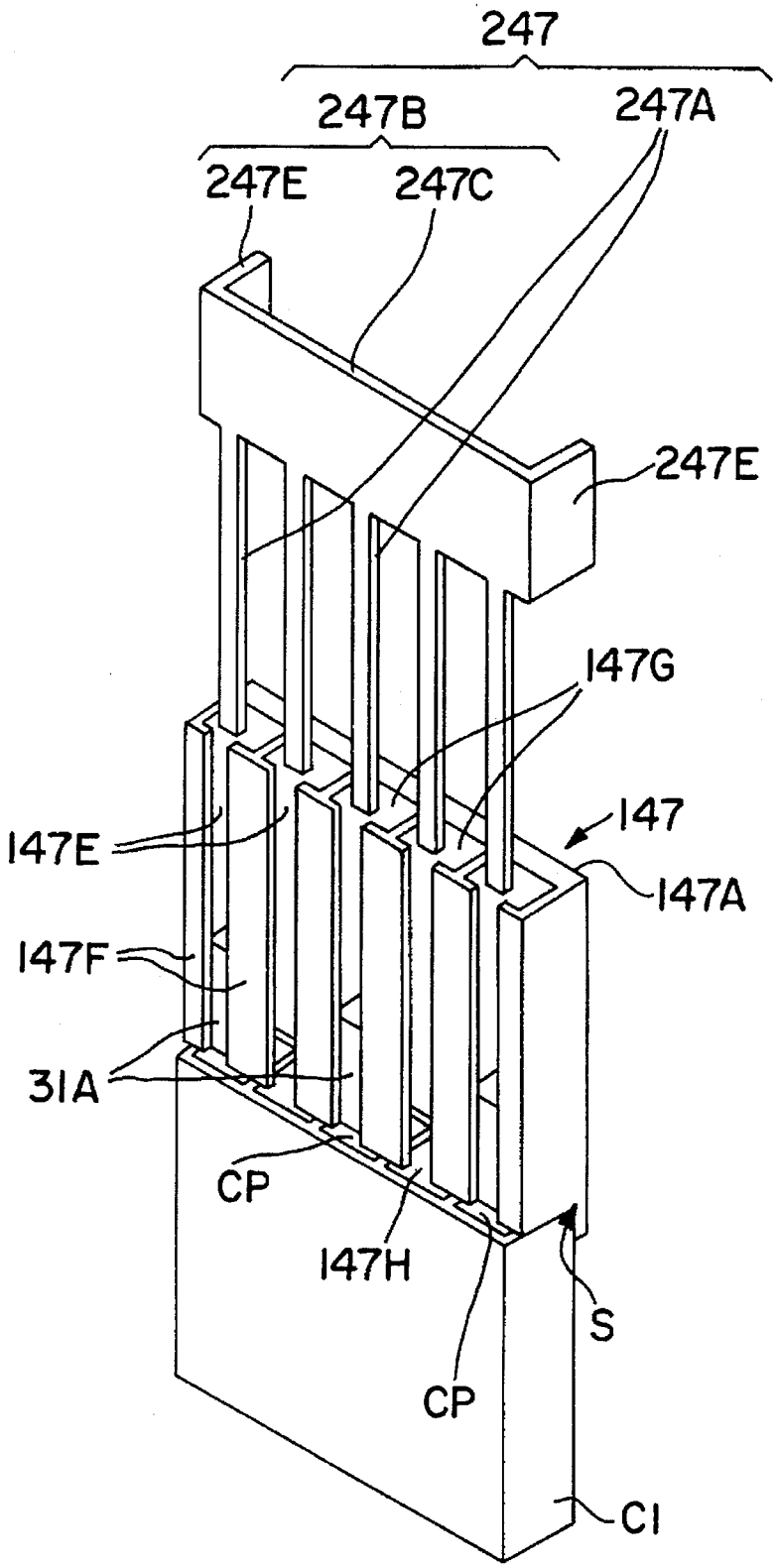
FIG. 10 is a perspective view showing the use of the insertion jig of the Invention.

In the case in which terminals 31A are not inserted into connectors C1 or C2 at all, the process as shown in FIG. 10 can be advantageously used. Exit 147H of holding jig 147 is positioned so that it faces insertion inlet CP of connectors C1 and C2. Ledge S is placed against the rim of connectors C1 and C2, thereby precisely aligning terminals 31A in each receiving chamber 147E with its corresponding insertion inlet CP. Thus, the ease and accuracy of assembly is substantially improved.

After jig 147 has been properly positioned with respect to inlet CP, all terminals 31A can be pressed through exit 147H and inlet CP by insertion jig 247. Insertion jig 247 conforms to receiving chambers 147E, and is equipped with contact members 247A which pass through entry 147G. Each contact member 247A is formed in a bar shape of rectangular cross section. Each contact member 247A is preferably integrally formed with pusher 247B; pusher 247B is of U-shape as seen from the top, and has base 247C with sides 247E at a right angle thereto. By inserting each contact member 247A through each terminal inlet 147G, into each receiving chamber 147E, and by urging terminals 31A towards exits 147H, they are released by stop J4 and are all pushed through exits 147H at the same time into insertion inlet CP.

Figure 11:
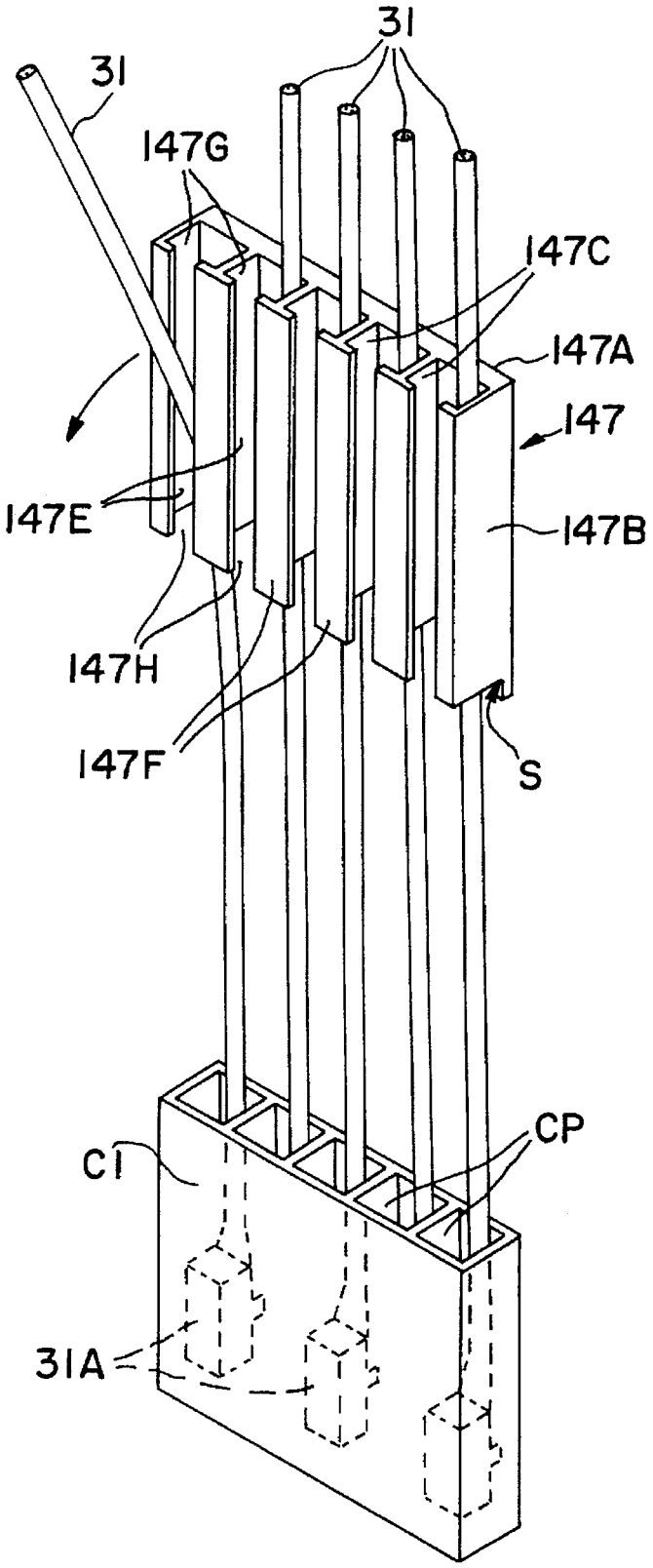
FIG. 11 is a perspective view showing the removal of the cables from the holding jig.

As shown in FIG. 11, cable 31 to be removed from chamber 147E is passed through gap 147L. This permits holding jig 147 to be separated from cables 31 which have now been formed into wire harness WH. Since each terminal 31A which comprises a circuit such as binding circuit 2x is held in a corresponding receiving chamber 147E, it is protected from outer forces, thereby making it possible to prevent deformation during transport and entanglement during manufacture. In addition, by removably accommodating terminals 31A, holding jig 147 can be reused many times.

Furthermore, ledge S positions exit 147H of chamber 147E adjacent insertion inlet CP of connectors Cl and C2, whereby operability is improved, thus achieving an effective final binding. In addition, by the use of insertion jig 247, all terminals 31A can be connected to contacts C1 and C2 in one step, whereby completion of the final binding wire harness can be carried out effectively, accurately, and conveniently. Also, by conforming the exterior of main body 147A to insertion inlet CP and the test apparatus, erroneous connections made by the operator can be readily detected by performing continuity tests for all temporary binding circuits prior to the final binding process which forms wire harness WH.

Figure 12:
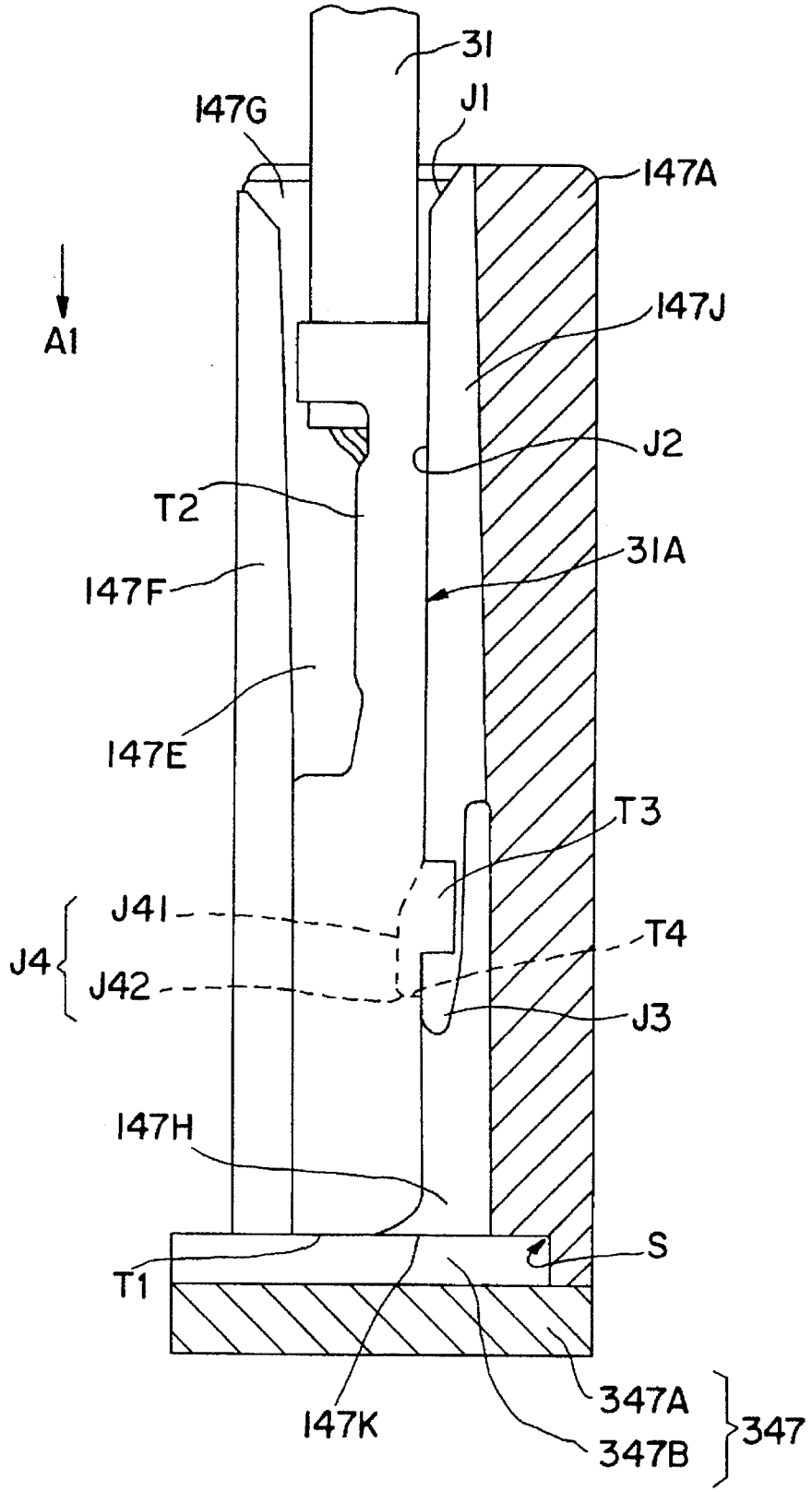
FIG. 12 is a vertical sectional view, similar to FIG. 2, showing a retaining jig in combination with the temporary holding jig of FIG. 1.

While only a limited number of specific embodiments of the present invention have been expressly disclosed, such modifications as would suggest themselves to the person of ordinary skill may be made without departing from the scope or spirit thereof. For instance, as shown in FIG. 12, when temporarily holding terminals 31A in holding jig 147, the use of retaining jig 347 is a satisfactory alternative if terminals 31A do not protrude from receiving chambers 147E. Retaining jig 347 comprises base 347A which contacts the lower face of main body 147A, and is integrally equipped with protrusion 347B which positions tips T1 at exits 147H. By the use of retaining jig 347, terminals 31A can be more positively temporarily held in holding jig 147.

Figure 14:
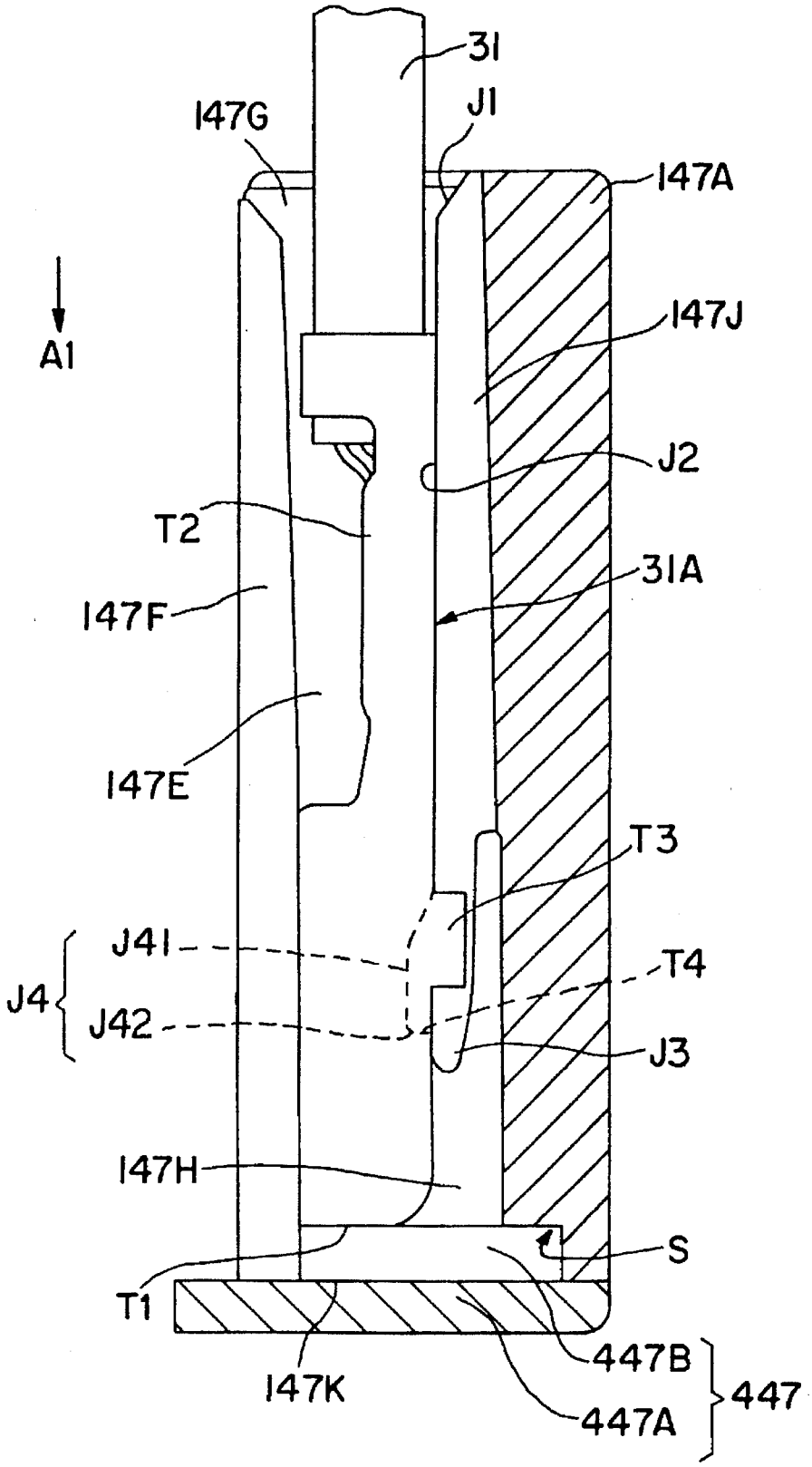
FIG. 14 is a vertical sectional view similar to FIG. 12, showing another retaining jig in combination with the inventive temporary holding jig.

Alternatively, as shown in FIG. 14, retaining jig 447 may be substituted for retaining jig 347. It comprises base 447A which rests against ledge S of main body 147A and is provided with protrusion 447B which fits between the inner surface of main body 147A and the inner surface of cross pieces 147F. This permits terminals 31A to be held within chamber 147E for additional protection. In a further variation of the invention, stop J4 can be omitted. In that case, terminals 31A are retained in holding jig 147 by the friction between the outer surface of terminals 31A and the inner surfaces of receiving chambers 147E.

These and other design changes in the invention may be made while remaining within the purview thereof. It is, therefore, to be broadly construed and not to be limited except by the character of the claims appended hereto.

What we claim is:

1. A holding jig for temporarily retaining a plurality of last-in terminals, said terminals being electrically connected to a plurality of corresponding cables, said terminals and said cables constituting a wire harness, said jig comprising a plurality of longitudinal receiving chambers, parallel to and adjacent one another, each of said chambers having a terminal entry at an upper end and a terminal exit at a lower end, said terminal exit being at least as large as a cross section of said terminal to permit the ejection of said terminals through said terminal exit by pressure applied thereon in a downstream direction from said upper end toward said lower end, the distance between said upper end and said lower end of each of said chambers being longer than the length of said terminals in said downstream direction to thereby enclose one of said terminals therein.

2. The holding jig of claim 1 wherein a longitudinal gap is provided in each of said receiving chambers to permit passage of each of said cables therethrough in a direction perpendicular to said downstream direction.

3. The holding jig of claim 1 wherein said terminals are retained in said chambers by friction between outer surfaces of said terminals and inner surfaces of said chambers.

4. The holding jig of claim 1 comprising an insertion jig having a plurality of contact members, each adapted for downstream entry into a corresponding one of said receiving chambers to bear against each of said plurality of terminals, a base to which said contact members are attached, whereby insertion of said insertion jig into said receiving chambers exerts downstream pressure against said plurality of terminals.

5. The holding jig of claim 4 wherein an insertion inlet leading to at least one mating connector is adjacent said terminal exit, whereby said terminals enter said inlet upon ejection from said holding jig.

6. The holding jig of claim 1 wherein an insertion inlet, leading to at least one mating connector, is adjacent said terminal exit, whereby said terminals enter said inlet upon ejection from said holding jig.

7. The holding jig of claim 1 wherein a wall of one of said receiving chambers extends beyond and downstream of said lower end and said exit, thereby forming a ledge, said ledge being complementary to a receptacle for said terminals.

8. The holding jig of claim 1 wherein each of said chambers is enclosing one of said terminals and a portion of one of said cables at the same time.

9. A method of temporarily retaining a plurality of last-in terminals, said terminals being electrically connected to a plurality of cables to form a wire harness, said method comprising insertion of each of said terminals in a downstream direction into a terminal entry of a corresponding receiving chamber in a holding jig, said jig comprising a plurality of longitudinal receiving chambers, parallel to and adjacent one another, each of said chambers having a terminal entry at an upper end and a terminal exit at a lower end, said terminal exit being at least as large as a cross section of said terminal to permit the ejection of said terminals through said terminal exit by pressure applied thereon in a downstream direction from said upper end toward said lower end, the distance between said upper end and said lower end of each of said chambers being longer than the length of said terminals in said downstream direction to thereby enclose one of said terminals entirely within said chamber, then exerting ejection pressure on said terminals in said downstream direction, thereby ejecting said terminals from said terminal exit of said jig.

10. The method of claim 9 wherein all said terminals are ejected simultaneously.

11. The method of claim 9 wherein at least one of said cables is inserted into and/or withdrawn from a corresponding receiving chamber through a longitudinal opening therein in a second direction perpendicular to said downstream direction.

12. The method of claim 11 wherein at least one of said cables is withdrawn from said corresponding receiving chamber in said second direction after said terminal has been ejected from said jig.

13. A holding jig for temporarily retaining a plurality of last-in terminals, said terminals being electrically connected to a plurality of corresponding cables, said terminals and said cables constituting a wire harness, said jig comprising a plurality of longitudinal receiving chambers, parallel to and adjacent one another, each of said chambers having a terminal entry at an upper end and a terminal exit at a lower end, each of said chambers adapted to receive one of said terminals and a portion of one of said cables connected thereto, said jig being open at said lower end, adapted to permit the ejection of said terminals by pressure thereon in a downstream direction from said upper end toward said lower end, a longitudinal guide rib against one internal wall of each of said chambers and at least one stabilizer adapted to slide along said rib on each of said terminals.

14. The holding jig of claim 13 wherein at least one slot is provided adjacent said rib, said stabilizer adapted to slide in said slot.

15. The holding jig of claim 14 wherein there are two slots, one on either side of said rib, and two stabilizers, one slidable in each of said slots.

16. The holding jig of claim 13 wherein said rib has an upper surface which is inclined away from said wall in said downstream direction.

17. The holding jig of claim 16 wherein said rib has a stop on its upper surface at a downstream end of said rib, a hole in said terminal adapted to receive said stop when said terminal is in a retained position in said chamber, said upper surface having an edge adapted to bear against a rim of said hole to prevent withdrawal of said terminal in an upstream direction.

* * * * *